US011359892B2

(12) United States Patent
Hening et al.

(10) Patent No.: US 11,359,892 B2
(45) Date of Patent: Jun. 14, 2022

(54) SYSTEM AND METHOD FOR LASER-INDUCED PLASMA FOR INFRARED HOMING MISSILE COUNTERMEASURE

(71) Applicant: The United States of America as represented by the Secretary of the Navy, San Diego, CA (US)

(72) Inventors: Alexandru Hening, San Diego, CA (US); Ryan P. Lu, San Diego, CA (US); Ayax D. Ramirez, Chula Vista, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 983 days.

(21) Appl. No.: 16/055,684

(22) Filed: Aug. 6, 2018

(65) Prior Publication Data

US 2020/0041236 A1 Feb. 6, 2020

(51) Int. Cl.

| | |
|---|---|
| ***F41J 2/02*** | (2006.01) |
| ***F41H 11/02*** | (2006.01) |
| ***F41H 13/00*** | (2006.01) |

(52) U.S. Cl.

CPC ..... *F41J 2/02* (2013.01); *F41H 11/02* (2013.01); *F41H 13/005* (2013.01)

(58) Field of Classification Search

CPC ..... F41J 2/02; F41H 11/02; F41H 3/005

USPC ..... 89/1.1

See application file for complete search history.

(56) References Cited

U.S. PATENT DOCUMENTS

| | | | | |
|---|---|---|---|---|
| 8,981,261 | B1 * | 3/2015 | Tillotson | F41H 13/0093 219/383 |
| 2009/0173836 | A1 * | 7/2009 | Kremeyer | F41H 13/005 244/204 |
| 2016/0097616 | A1 * | 4/2016 | Weigold | F41H 13/0062 250/396 R |
| 2020/0041236 | A1 * | 2/2020 | Hening | F41H 11/02 |
| 2020/0363444 | A1 * | 11/2020 | Tillotson | G01F 1/60 |

OTHER PUBLICATIONS

"US Navy scientists can trick heat-seeking missiles with 'ghost' aircraft" by Troy Carter; Feb. 6, 2020; https://techlinkcenter.org/news/us-navy-scientists-can-trick-heat-seeking-missiles-with-ghost-aircraft (Year: 2020).*

"Why The Army's Experimenting With Laser-Guided Lightning" by Sydney Freedberg Jr; Jul. 5, 2012; https://breakingdefense.com/2012/07/why-the-armys-experimenting-with-laser-guided-lightning/ (Year: 2012).*

* cited by examiner

*Primary Examiner* — Samir Abdosh

(74) *Attorney, Agent, or Firm* — Naval Information Warfare Center, Pacific; Kyle Eppele; Matthew D. Pangallo

(57) ABSTRACT

A method where a laser beam is configured to generate a laser-induced plasma filament (LIPF), and the LIPF acts as a decoy to detract a homing missile or other threat from a specific target.

19 Claims, 3 Drawing Sheets

SYSTEM AND METHOD FOR LASER-INDUCED PLASMA FOR INFRARED HOMING MISSILE COUNTERMEASURE

FEDERALLY-SPONSORED RESEARCH AND DEVELOPMENT

The System and Method for Laser-Induced Plasma for Infrared Homing Missile Countermeasure is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-5118; email ssc_pac_T2@navy.mil. Reference Navy Case Number 102680.

BACKGROUND

Laser induced plasma emission spectra covers a wide electromagnetic spectrum, from Infrared (IR) to Visible (VIS) and up to Ultraviolet region ((UV). By fine-tuning the interaction parameters (e.g. laser wavelength, laser temporal and spatial pulse profile, and etc.) it is possible to maximize the radiating power for a dedicated electromagnetic spectrum.

Presently, IR-guided missiles are very difficult to find as they approach a target. They do not emit detectable radar, and they are generally fired from a rear visual-aspect, directly toward the engines. Since IR-guided missiles are inherently far shorter-legged in distance and altitude range than their radar-guided counterparts, good situational awareness of altitude and potential threats continues to be an effective defense. Once the presence of an activated IR missile is indicated, flares are released in an attempt to decoy the missile; some systems are automatic, while others require manual jettisoning of the flares. Flares burn at thousands of degrees, which is much hotter than the exhaust of a jet engine. IR missiles seek out the hotter flame, believing it to be an aircraft in afterburner or the beginning of the engine's exhaust source.

As the more modern infrared seekers tend to have spectral sensitivity tailored to more closely match the emissions of airplanes and reject other sources (the so-called CCM, or counter-countermeasures), the modernized decoy flares need to have their emission spectrum optimized to also match the radiation of the airplane (mainly its engines and engine exhaust). In addition to spectral discrimination, the CCMs can include trajectory discrimination and detection of size of the radiation source.

Described herein is a system and method to generate a plasma-based decoy flare by using a laser source, to counter an infrared homing surface-to-air and/or air-to-air missile. With laser-induced plasma (LIP), it is possible to generate multiple wavelengths just by "tuning" the laser parameters. This method allows for an ultra-fast response time. Due to the fact that the effect is generated by the laser beam interaction with air, the time required to produce the flares is less than a millionth of a second.

DETAILED DESCRIPTION OF SOME EMBODIMENTS

Reference in the specification to "one embodiment" or to "an embodiment" means that a particular element, feature, structure, or characteristic described in connection with the embodiments is included in at least one embodiment. The appearances of the phrases "in one embodiment", "in some embodiments", and "in other embodiments" in various places in the specification are not necessarily all referring to the same embodiment or the same set of embodiments.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or.

Additionally, use of the "a" or "an" are employed to describe elements and components of the embodiments herein. This is done merely for convenience and to give a general sense of the invention. This detailed description should be read to include one or at least one and the singular also includes the plural unless it is obviously meant otherwise.

Figure 1:
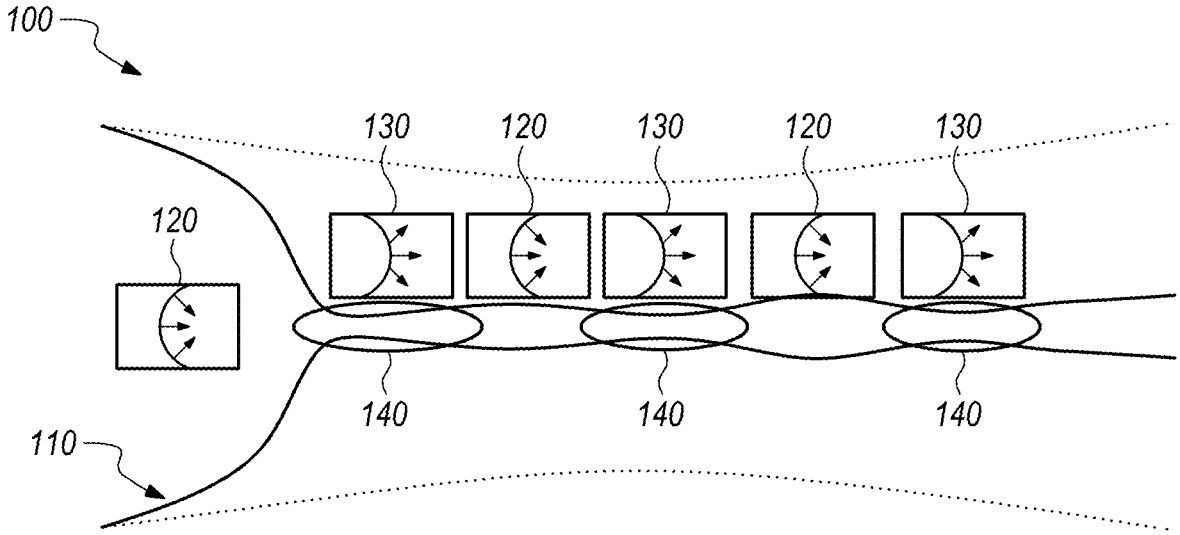
FIG. 1 shows an illustration of a laser beam that will generate a laser-induced plasma filament (LIPF) in accordance with the system and method for laser-induced plasma for infrared homing missile countermeasure.

FIG. 1 shows a diagram 100 of an intense laser pulse 110 with peak power exceeding the critical power threshold as it first undergoes self-focusing.

Critical power threshold for self-focusing:

$$P_{cr} = \frac{3.72\lambda_0^2}{8\pi n_0 n_2}$$

An intense laser pulse has the power required to start self-focusing as defined by the propagation media, on the order of Gigawatts of peak power for near-infrared propagation through sea-level air. Laser pulse 110 can be infrared or ultraviolet. The self-focusing of laser pulse 110 is due to an optical Kerr effect 120 and the diffraction from the resulting plasma 130.

Optical Kerr Effect: $n=n_0+n_2I$ where $n_2$ is $\sim 10^{-23}$ $m^2/W$

During its propagation in air, the intense laser pulse 110 first undergoes self-focusing, because of the optical Kerr effect, until the peak intensity becomes high enough (~5*$10^{13}$ W/$cm^2$) to ionize air molecules. The ionization process involves the simultaneous absorption of 8-10 infrared photons, and has a threshold-like behavior and a strong clamping effect on the intensity in the self-guided pulse, further described below. A dynamical competition then starts taking place between the self-focusing effect due to the optical Kerr effect and the defocusing effect due to the created plasma 130. During the dynamical competition, there is an equilibrium in the propagation between the self-focusing effect and the plasma defocusing effect.

Plasma Defocus: $n_p=\sqrt{1-N/N_c}$ where N is the number of free electrons and $N_c$ is the critical plasma density.

When the self-focusing gets high, it creates resulting plasma 130 which causes defocusing. When the intensity is lower due to plasma 130 defocusing, then it starts to self-focus again. This repeating of focusing and defocusing, called self-guiding, continues until the peak intensity is no longer high enough to return to self-focusing and the laser beam begins propagating in a normal fashion.

Peak Pulse Intensity due to intensity clamping $$I \sim \left(\frac{0.76 n_2 \rho_c}{\sigma_K t_p \rho_{nt}}\right)^{1/(K-1)}$$

Peak Plasma Density $$\rho(I) \sim \left(\frac{(0.76 n_2 \rho_c)^K}{\sigma_K t_p \rho_{nt}}\right)^{1/(K-1)}$$

Filament Size $$\omega_0 \sim \left(\frac{2P_{cr}}{\pi}\right)^{1/2} \times \left(\frac{\sigma_K t_p \rho_{nt}}{0.76 n_2 \rho_c}\right)^{1/2(K-1)}$$

As a result, the pulse maintains a small beam diameter and high peak intensity over large distances. In the wake of the self-guided pulse, a plasma column 140 is created with an initial density of $10^{13}$-$10^{17}$ electrons/cm3 over a distance which depends on initial laser conditions. This length can reach hundreds of meters at higher powers and typical LIPF equivalent resistivity could be as low as 0.1 Ω/cm. These types of parameters support plasma/electromagnetic field interactions such as reflection and refraction. Optical beams of low power propagate in a manner that is described by standard Gaussian propagation equations. In this type of propagation, the beam size at the focus of the system is only generally maintained to a distance around the focal region called the Rayleigh range. In high-power self-guiding propagation, this small beam size is maintained as long as the pulse intensity is high enough to continue generating Kerr self-focusing, generally 10× or more the Rayleigh range.

Through optical beam forming techniques, an array of plasma columns 140 can be created, forming a sheet-like plasma, creating a layer of excited electrons in the air. This layer can be used as a reflective surface, or mirror, for incident energies whose frequencies are below the plasma frequency, reflecting the power away from the intended path. The layer can also be used instead to deflect, diffract, or redirect the incident energy in a different direction.

By rastering plasma 130, it is possible to generate a 2D or 3D volumetric image in space. This is analogous to the rastering of an electron beam in a cathode ray tube based television. In one potential embodiment, a laser system would be mounted on the back of an air vehicle such that the beam can be rastered using optics and mirrors to generate a large 'ghost' image in space. This 'ghost' image would appear to detract the homing missile away from the tangible air vehicle. In a second embodiment, there can be multiple laser systems mounted on the back of the air vehicle with each laser system generating a 'ghost image' such that there would appear to be multiple air vehicles present. The homing missile will have 1/n chances of tracking the correct target where 'n' is the number of decoys.

Figure 2:
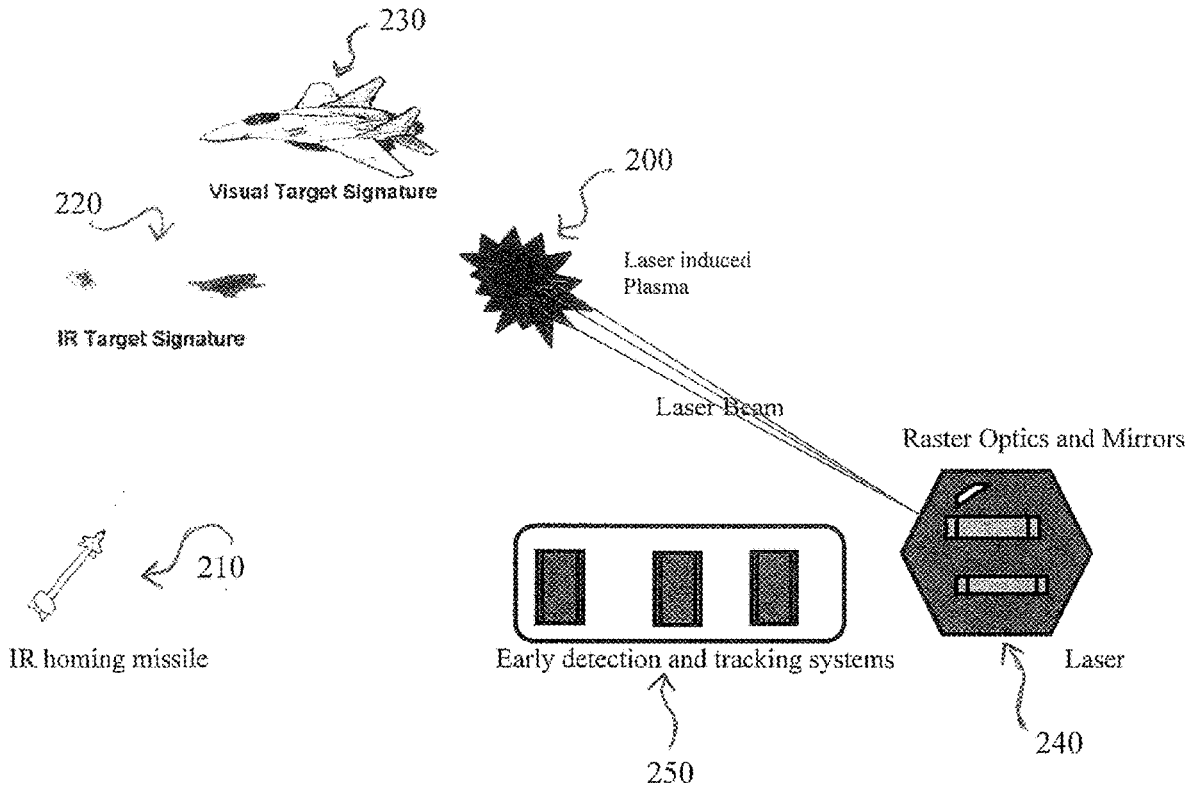
FIG. 2 shows an illustration of a laser induced plasma (LIP) in air as a decoy for an incoming infrared guided missile as compared to an infrared signature of an air vehicle in accordance with the system and method for laser-induced plasma for infrared homing missile countermeasure.
Figure 3:
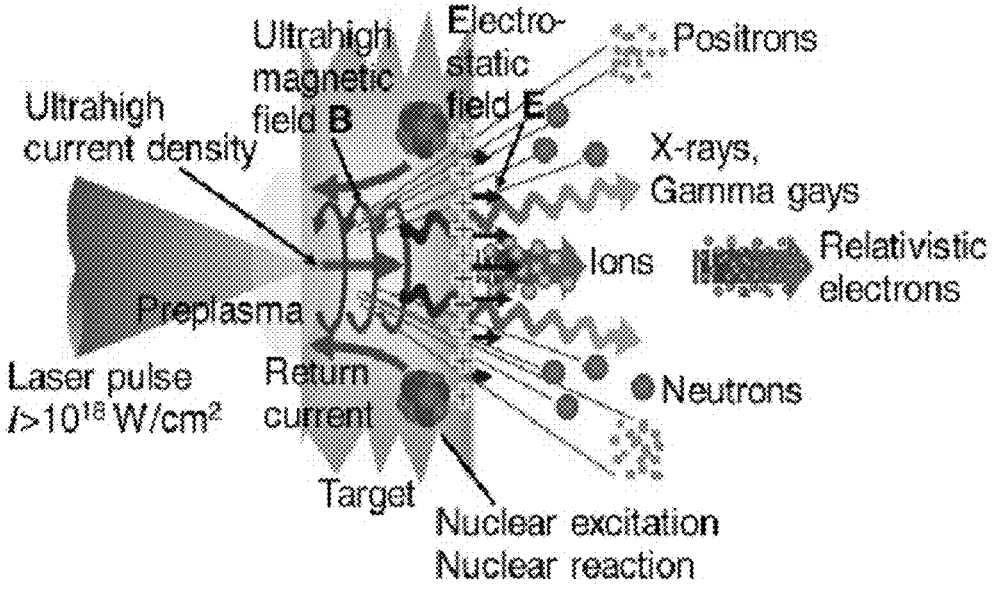
FIG. 3 shows the potential Emission Spectrum of Laser Induced Plasma in accordance with the system and method for laser-induced plasma for infrared homing missile countermeasure.

FIG. 2 shows an illustration of a laser induced plasma (LIP) 200 in air as a decoy for an incoming IR guided missile 210 as compared to the infrared signature 220 of an air vehicle 230. LIP 200 can be generated using a 248 nm KrF excimer laser. In addition to a LIP, any other type of laser or light and/or electromagnetic source can be used as a decoy in this manner, including radio frequency (RF) and Microwave generators, High Power Lasers (HEL) and High Power LEDs. Depending on the desired use, the pulse characteristics of the electromagnetic source (energy, pulse shape, duration, repetition rate) are critical in achieving the required plasma parameters. A laser source 240 is mounted on the back of air vehicle 230 with mirrors and optics that would enable the raster scanning of laser source 240 to create LIP 200, which acts as a virtual 'ghost' object. Alternatively, LIP 200 could also be manipulated and distributed using a laser gimbal or turret which can be easily installed on air vehicle 230, which could be anything from an (aircraft, helicopter, ship, etc.). As is shown in FIG. 3, LIP 200 has an extremely broad-band emission spectrum, from RF to Gamma Rays, making possible the development of countermeasure systems for future detection and seeking techniques. Air vehicle 230 can also have an early detection and tracking system 250 to indicate an incoming threat. Once a threat is detected, a countermeasure via LIP 200 can be deployed immediately with no delay time whatsoever.

An LIP flare array propagates in air at the speed of light, allowing for immediate deployment of a countermeasure to protect against an incoming threat. The potential applications of this LIP flare/decoy can be expanded, such as using a helicopter deploying flares to protect a battleship, or using this method to cover and protect a whole battle-group of ships, a military base or an entire city.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A method comprising:

using a laser beam to generate a laser-induced plasma filament (LIPF);

using the LIPF to detract a homing missile from a specific target, wherein using the LIPF to detract the homing missile includes rastering the LIPF using optics and mirrors to generate a volumetric image in space, and wherein the volumetric image is used to detract the homing missile.

2. The method of claim 1, further comprising:

mounting a laser system on the back of an air vehicle, wherein the laser system is configured to produce the laser beam.

3. The method of claim 2, further comprising:

mounting a plurality of laser systems on the back of an air vehicle, wherein each laser system is configured to generate a ghost image such that a plurality of air vehicles appear to be present.

4. The method of claim 1, wherein the LIPF was generated using a 248 nm KrF excimer laser.

5. A method comprising:

configuring a laser source to generate a laser-induced plasma filament (LIPF);

rastering the LIPF to generate a multi-dimensional volumetric image in space, using the multi-dimensional volumetric image to detract a threat from an intended target.

6. The method of claim 5, wherein the laser source is mounted on the back of an air vehicle such that the multi-dimensional volumetric image can detract a threat from the air vehicle.

7. The method of claim 5, wherein a plurality of laser sources are mounted on the back of an air vehicle, and wherein the laser sources are configured to generate a ghost image creating the appearance of a plurality of air vehicles.

8. The method of claim 6, further comprising the step of coupling an early detection and tracking system to the air vehicle.

9. The method of claim 8, further comprising the step of manipulating the LIPF using a laser gimbal.

10. The method of claim 8, further comprising the step of manipulating the LIPF using a turret.

11. The method of claim 5, wherein the laser source is mounted on the back of a ship, such that the multi-dimensional volumetric image can detract a threat from the ship.

12. A system comprising:

an air vehicle; wherein a laser source, wherein the laser source is mounted on the back of the air vehicle and configured to create a laser-induced plasma that acts as a decoy for an incoming threat to the air vehicle by rastering the laser-induced plasma using optics and mirrors to generate a volumetric image in space to act as the decoy for the incoming threat.

13. The system of claim 12, wherein the incoming threat is an infrared-guided missile.

14. The system of claim 12, wherein any electromagnetic source coupled to the air vehicle is used as a decoy.

15. The system of claim 12, wherein the laser-induced plasma has a broad-band emission spectrum including radio frequency and gamma rays.

16. The system of claim 12, wherein an early detection and tracking system is mounted on the air vehicle to indicate an incoming threat.

17. The system of claim 12, further including a plurality of laser sources on the back of the air vehicle, wherein each laser source is configured to generate a ghost image such that a plurality of air vehicles appear to be present.

18. The system of claim 12, further including an early detection and tracking system mounted on the air vehicle.

19. The system of claim 12, further including a laser gimbal or a turret to manipulate the laser source.

* * * * *